United States Patent [19]

Kawai et al.

[11] Patent Number: 4,660,709

[45] Date of Patent: Apr. 28, 1987

[54] ENTIRELY AUTOMATIC, COLD BOX TYPE MACHINE FOR MOLDING AN INTEGRAL CONNECTING CORE

[75] Inventors: Kazuo Kawai, Toyonaka; Sumikazu Kawai; Seiji Katashima, both of Amagasaki, all of Japan

[73] Assignee: Naniwa Products Co., Ltd., Japan

[21] Appl. No.: 705,791

[22] Filed: Feb. 26, 1985

Related U.S. Application Data

[62] Division of Ser. No. 486,938, Apr. 20, 1983, Pat. No. 4,559,989.

[51] Int. Cl.[4] ..... B65G 47/00

[52] U.S. Cl. ..... 198/339.1; 198/457

[58] Field of Search ..... 198/859, 339, 457, 570, 198/339.1; 29/33 P, 563

[56] References Cited

U.S. PATENT DOCUMENTS 2,986,261 5/1961 Wenstrand ..... 198/457

3,571,892 3/1971 Levy ..... 198/859

4,014,428 3/1977 Ossbahr ..... 198/626

*Primary Examiner*—Joseph E. Valenza

*Assistant Examiner*—Kyle E. Shane

*Attorney, Agent, or Firm*—Larson & Taylor

[57] ABSTRACT

An entirely automatic, cold box type machine for molding an integral connecting core, which machine is provided with a sand blowing mechanism and a gassing mechanism, these mechanisms being suspended above an upper frame of the molding machine and traversable, and with a liftable drag car being mounted on the platform of the molding machine, characterized in that a rotatable connecting core feeding device is provided at one side portion outside the molding machine, a reversing unloader is provided at the other side portion, and a connecting core transfer car having a connecting core lifting device is traversably suspended from the upper frame in parallel with the sand blowing mechanism and the gassing mechanism.

1 Claim, 13 Drawing Figures

ENTIRELY AUTOMATIC, COLD BOX TYPE MACHINE FOR MOLDING AN INTEGRAL CONNECTING CORE

This is a division of application Ser. No. 486,938 filed Apr. 20, 1983, now U.S. Pat. No. 4,559,989.

FIELD OF THE INVENTION

This invention relates to an entirely automatic, cold box type machine for molding an integral connecting core, and by "integral connecting core" referred to in this invention is meant a completed core in which some parts of a core of complicated shape or structure are separately molded, the molded core (connecting core) parts are arranged previously in core box, and then a molding material is filled in the mold cavities whereby the molded core parts are connected in integrity by means of the molding material.

BACKGROUND OF THE INVENTION

According to known technics which are adopted at present, cores of complicated shape or structure i.e. cores whose molding is difficult with a single molding operation are manufactured in such a way that some parts of a core are separately, previously molded, said parts are manually arranged in a core box for molding a complete core, and thereafter the complete core is molded. However, such conventional system troubles the worker so that the molding cycle is not constant and the work is accompanied by danger, and it is known to the skilled in the art that such molding is of poor efficiency.

SUMMARY OF THE INVENTION

The inventors of this invention have carried out lots of studies and experiments to improve said conventional system, and as a result they have been able to successfully develop the present invention.

The present invention provides an entirely automatic, cold box type machine for molding an integral connecting core, which machine is provided with a sand blowing mechanism and a gassing mechanism, said mechanisms being suspended above an upper frame of the molding machine and tranversable, and with a liftable drag car being mounted on the platform of the molding machine, characterized in that a rotatable connecting core feeding means is provided at one side portion outside said molding machine, a reversing unloader is provided at the other side portion, and a connecting core transfer car having a connecting core lifting means is traversably suspended from said upper frame in parallel with said sand blowing mechanism and said gassing mechanism.

Further, the present invention provides a connecting core feeding means for the molding machine of integral connecting cores, in which there are provided two rotatable feeding means in parallel on a rotary table, said means having an underframe, a number of connecting core holders are disengageably mounted in endless traverse chains provided on said underframe, a traverse cylinder for said traverse chains and a hook cylinder are disposed within said underframe, and a traverse cylinder for said feeding means is provided upon the rotary table.

Furthermore, the present invention provides split core boxes for the molding machine of integral connecting cores, which consist of a combination of a drag core box having cavities for inserting the connecting cores and a cope core box having fixed mandrels at its lower surface and a lot of blow ports, said drag core box consisting of a fixed pattern provided on the drag core box base, a pair of vise patterns which slide and engage with each other, a pair of loose pieces which slide perpendicularly crossing the sliding direction of said vise patterns, and at least one mandrel which pierces through said drag core box base and slides.

BRIEF DESCRIPTION OF THE DRAWINGS

The invention will now be described more in detail, by way of example, with reference to the accompanying drawings in which.

DETAILED DESCRIPTION OF THE PREFERRED EMBODIMENT

Figure 1:
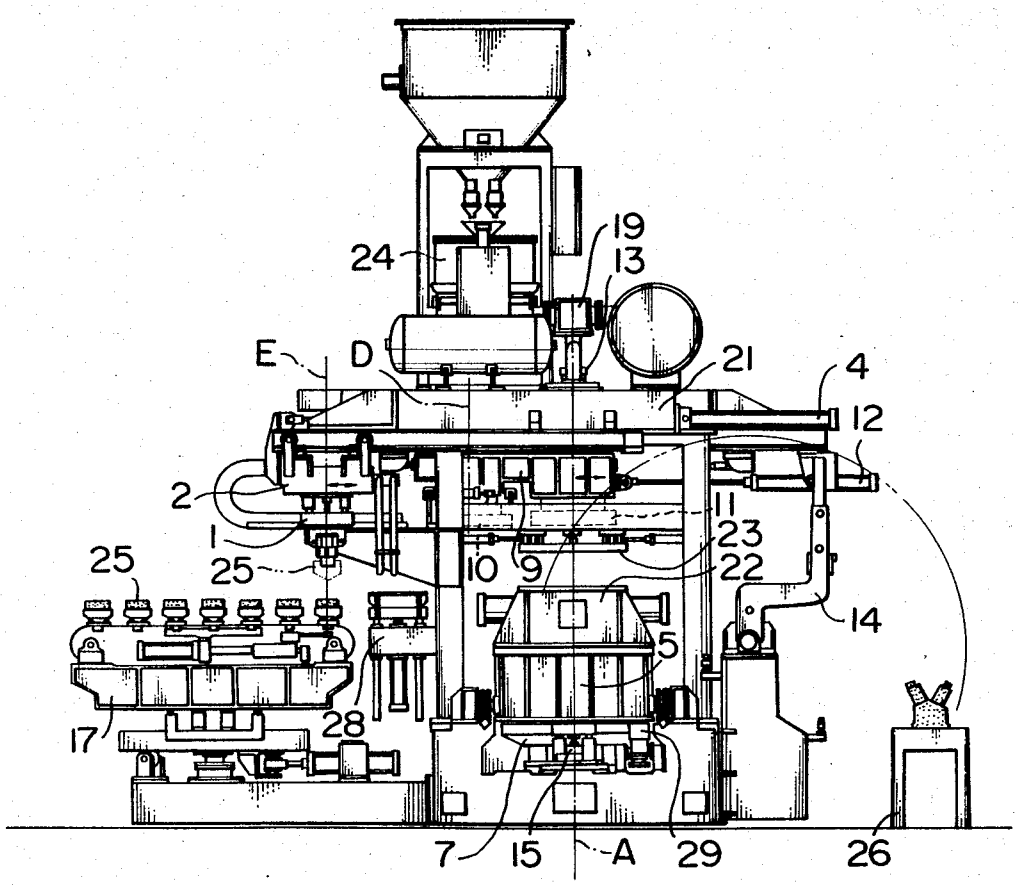
FIG. 1 is a front view of the molding machine of this invention.
Figure 2:
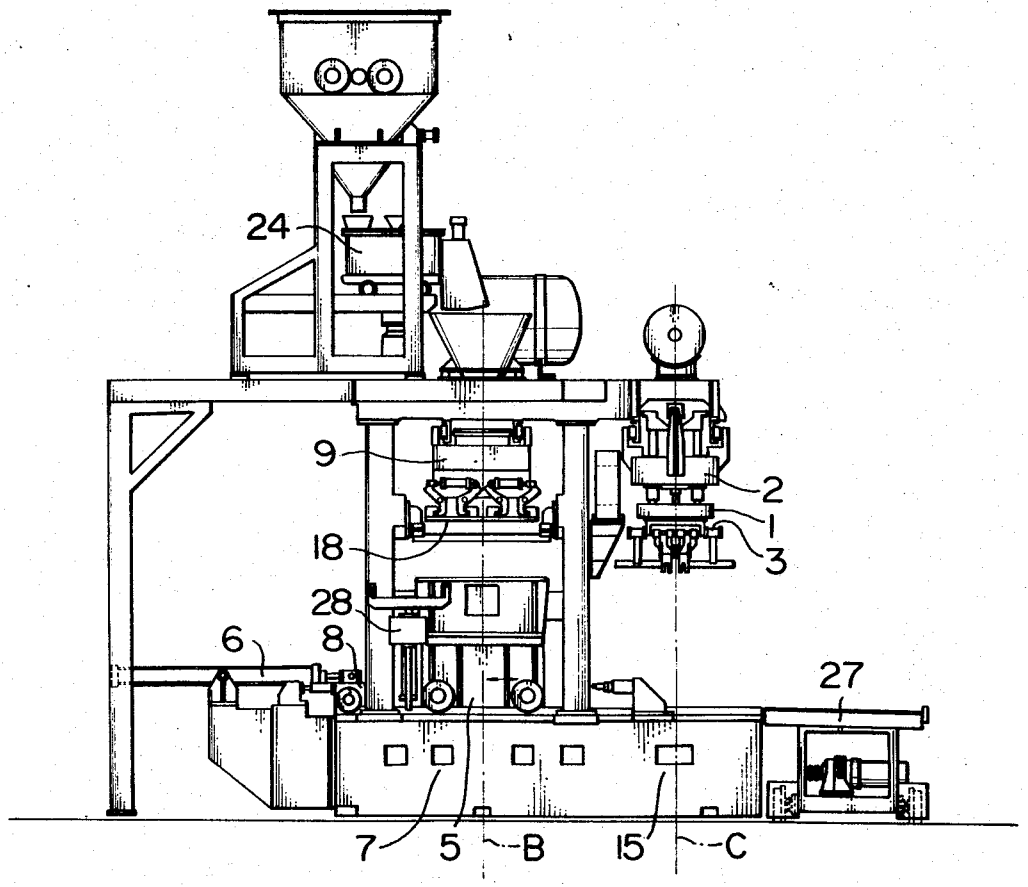
FIG. 2 is a side view of the molding machine from the left in FIG. 1, but the connecting core feeding means is omitted from the view.
Figure 3:
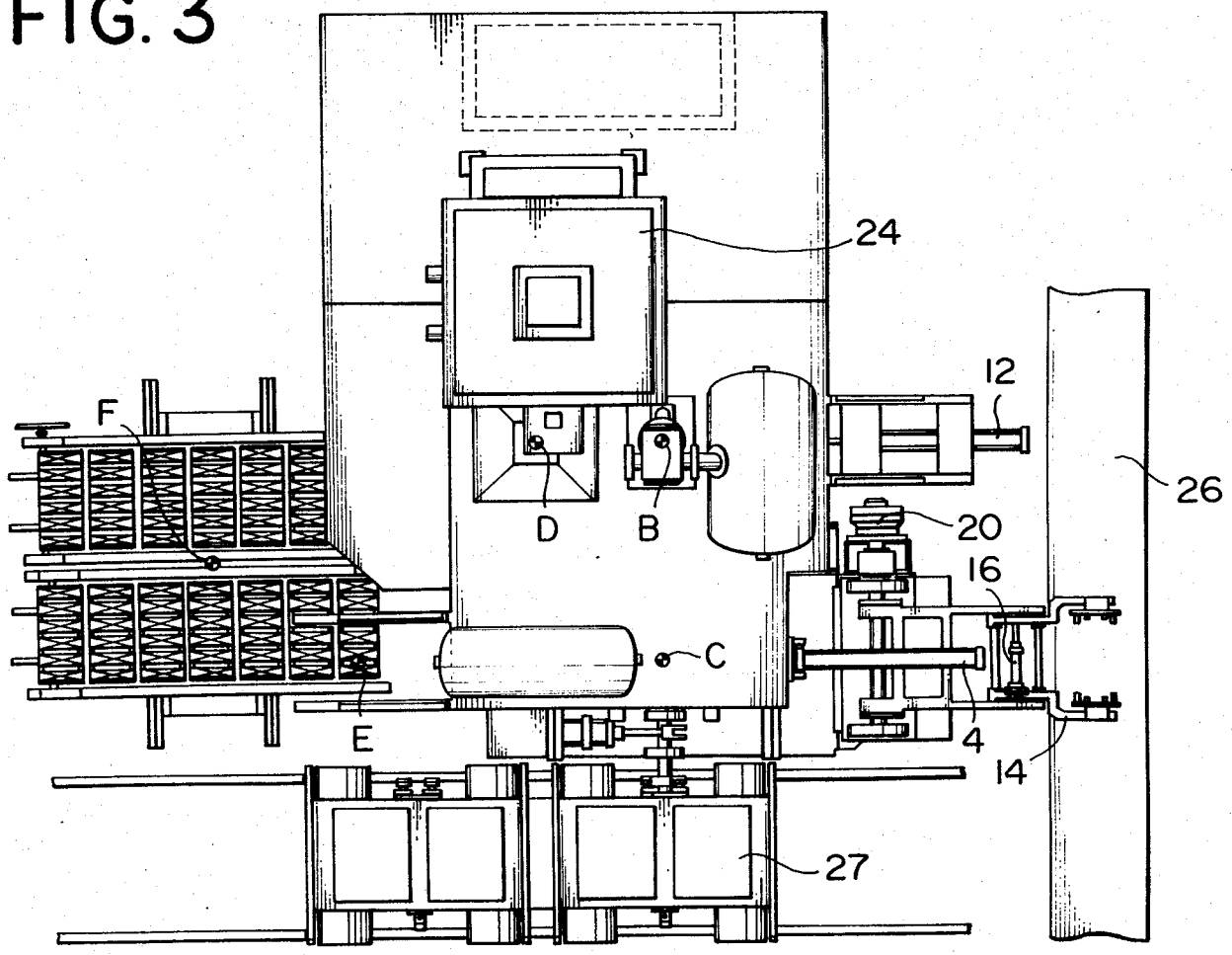
FIG. 3 is a top plan view of the molding machine in FIG. 1.

Referring to the drawings, in FIGS. 1 to 3 the reference numeral 9 designates a blow head car which is suspended from an upper frame 21 of the molding machine frame and which traverses on rails by the actuation of a traverse cylinder 12 for blow head, said blow head car 9 being provided usually with a blow head 10 and a gassing head 11 as shown. Reference 5 is a drag car whose mechanism is such that it places a drag core box 22 thereon, it vertically moves by a lifting means 7 for drag car mounted on the machine platform, it is provided with a core ejecting cylinder 15, and it can traverse by the operation of a traverse cylinder for drag car. Reference 23 is a cope core box disengageably arranged in the machine frame as already known.

On the upper frame 21 of the molding machine there are disposed a press cylinder having a blow valve 19, a sand mixer 24, a sand heater, and other necessary equipment.

Numeral 1 indicates a connecting core lifting means, and said means is constructed in such a way that as shown in FIG. 2 it is suspended from a connecting core transfer car 2 which moves on the rails disposed in parallel in front of the upper frame 21, it vertically moves by the cylinder not shown, it grasps a connecting core 25 set in a connecting core feeding means 17, by the operation of a chucking cylinder for connecting core, and then it travels onto a drag core box 22 by the actuation of a cylinder 4 for transfer car thereby to fit the connecting core 25 into the predetermined position at the molding cavity of said drag core box.

Reference 14 shows a reversing unloader, and it functions in such manner that its chucking portion carries out a reciprocal movement being actuated by a rotary actuator 20 between the surface of said drag core box 22 and a conveyor 26 for blown core, to allow the completed core to be placed on said conveyor 26.

Additionally, in the drawings, reference 18 designates a blow plate, reference (A) a machine center, reference (B) a blowing side center, reference (C) a take-out center, reference (D) a sand feeding center, reference (E) a connecting core chucking center, reference (F) a rotating center of feeding means, numeral 27 a core box exchanging car, numeral 28 a blow plate exchanging mechanism, and numeral 29 a core box exchanging cylinder, respectively.

Hereunder will now be described a mode of embodiment of an entirely automatic, cold box type machine for molding integral connecting cores, which embodiment is one example of the present invention as constituted above.

A number of previously molded connecting cores 25 are set, as shown, in the connecting core feeding means 17.

(a) Connecting core setting process:

The connecting core lifting means 1 is lowered thereby to retain a connecting core 25 at the position of said connecting core chucking center (E) by means of the connecting core chucking cylinders 3. Said connecting core lifting means 1 is lifted while retaining the connecting core 25. Then the connecting core transfer car 2 is moved, while retaining the connecting core 25, to the machine center (A) by the actuation of the cylinder 4 for transfer car. Said connecting core lifting means 1 is adjusted in such a way that it stops at each of the connecting core chucking center (E) and the machine center (A). Simultaneously with the stopping of the connecting core lifting means 1 at the machine center (A) the internally stored cylinder operates to insert the connecting core 25 into the predetermined position of the drag core box 22. After the insertion, the connecting core 25 is released from its being held by the connecting core chucking cylinders, when said connecting core lifting means 1 is raised and said connecting core transfer car 2 is moved for returning to the connecting core chucking center (E). Additionally, the drag car 5 in FIG. 2 is located at the blowing side center (B), but when said connecting core 25 is inserted into the drag core box 22 said drag car 5 may be located on the take-out center (C).

(b) Molding sand blowing process:

After the setting of a connecting core into the drag core box 22, the vise of the core box, the mandrels and the loose pieces are closed, and the drag car 5 is transferred from the take-out center (C) to the blowing side center (C) by means of the transfer cylinder 6 for drag car. At this time, the rod end of the transfer cylinder 6 is fixed to a terminal car 8 which is connected to said drag car 5 by hook. Then the drag car 5 positioned at the blowing side center (B) is lifted by a lifting means 7 for drag car to allow the drag core box 22 to be brought into close contact with the cope core box 23. The hook-connecting portion of the terminal car 8 with the drag car 5 is of sliding mechanism, and the terminal car 8 does not lift up.

By the operation of said traverse cylinder 12 for blow head the blow head car 9 is moved, while the blow head 10 is transferred from the sand feeding center (D) to the machine center (A). The blow head 10 positioned on the machine center (A) is lowered by a press cylinder 13 until a blow plate 18 is brought into close contact with the cope core box. In such condition that the drag core box 22 which has been lifted by the drag car 5 and the blow plate 18 are in close contact with the cope core box 23, a blow valve 19 is opened to blow the molding sand within the blow head 10 into the molding cavity within the core box. The remaining pressure of the blown air within said blow head 10 after the finishing of the blowing is exhausted. After the exhaustion the blow head 10 is raised by the press cylinder 13, when said blow head is raised by means of the spring (not shown) stored in the blow head car 9.

(c) Gassing process:

The blow head car 9 is moved by said cylinder 12, and a gassing head 11 is moved onto the machine center (A) to stop thereon. In such case, the blow head 10 lies on the sand feeding center (D) when sand is fed into said blow head from a hopper.

The gassing head 11 located on the machine center (A) is lowered to be in close contact with the rear surface of the cope core box 23 by the press cylinder 13, and then ejecting-shaping pins (not shown) stored in the gassing head 11 are lowered whereby the molding sand remaining at the blow port of said cope core box 23 is shaped for the surface of the core. After the shaping of the blow ports, the sand filled in the core box cavity is hardened by blowing a gas for hardening or a reacting gas supplied from a gas generating device (not shown) thereby making a complete core connected in integrity with the connecting core 25 previously inserted.

The gas for hardening is discharged after the finishing of said hardening reaction, while the gassing head 11 is raised for returning.

(d) Releasing and carrying-out processes:

The lifting means 7 for drag car is actuated, and the drag car 5 retaining the molded integral connecting core is lowered and stops at the predetermined position.

The reversing unloader 14 is reversed 90° toward the core box side from the neutral position shown in FIG. 1 by a rotary actuator 20, and the drag core box 5 is transferred from the blowing side center (B) to the take-out center (C) by the traverse cylinder 6 for drag car so that it may stop at the center (C). Further, a core ejecting cylinder 15 provided in the drag car 5 is actuated, and ejector pins (not shown) are projected into the drag core box 22 so that the integral connecting core may be pressed up into the frame of said previously reversed unloader 14 thereby to be released.

The molded integral connecting core pressed up into the frame of the reversing unloader 14 is tightly held by the chucking cylinder 16 for unloader, said unloader 14 is reversed 180° to come onto a conveyor 26 for blown core, said chucking cylinder 16 is opened, and the integral connecting core is placed upon the conveyor 26 for the molded core to be permitted for carrying out. The reversing unloader 14 is reversed by 90° to be returned to the neutral position, and at the same time the core ejecting cylinder 15 within the drag core box 5 is returned to be shifted to the subsequent cycle.

The above is an explanation of the molding cycle of the molding machine of this invention. The invention will be further described in detail with regard to the construction and operating mode of the feeding means of connecting cores 25, which means is one of the features of the invention.

Figure 6:
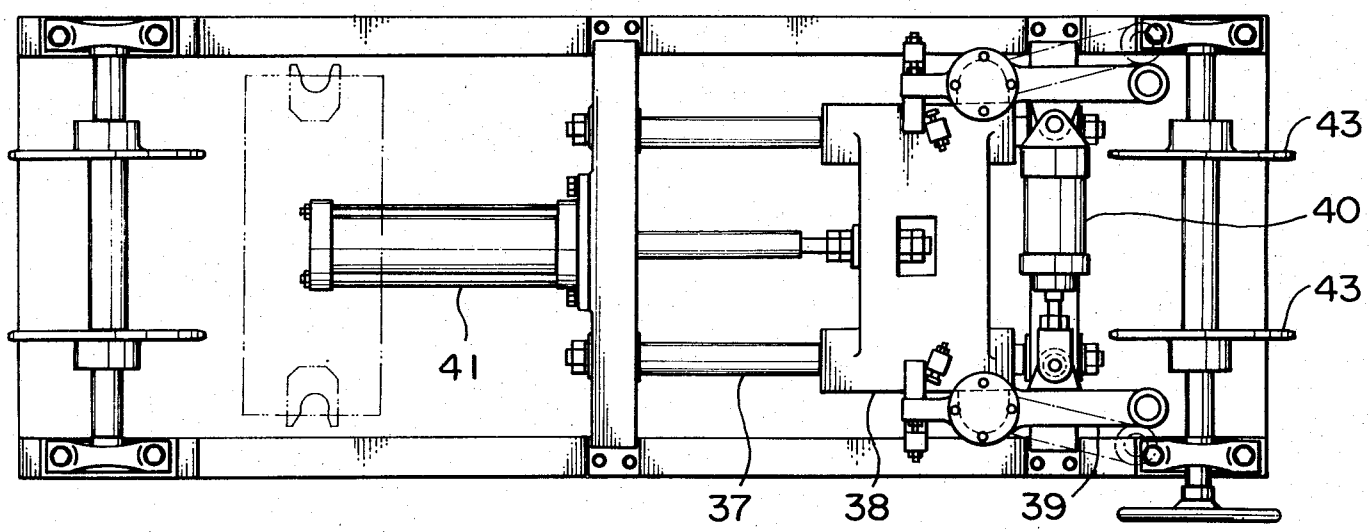
FIG. 6 is a top plan view taken along the line VI—VI of FIG. 5.
Figure 7:
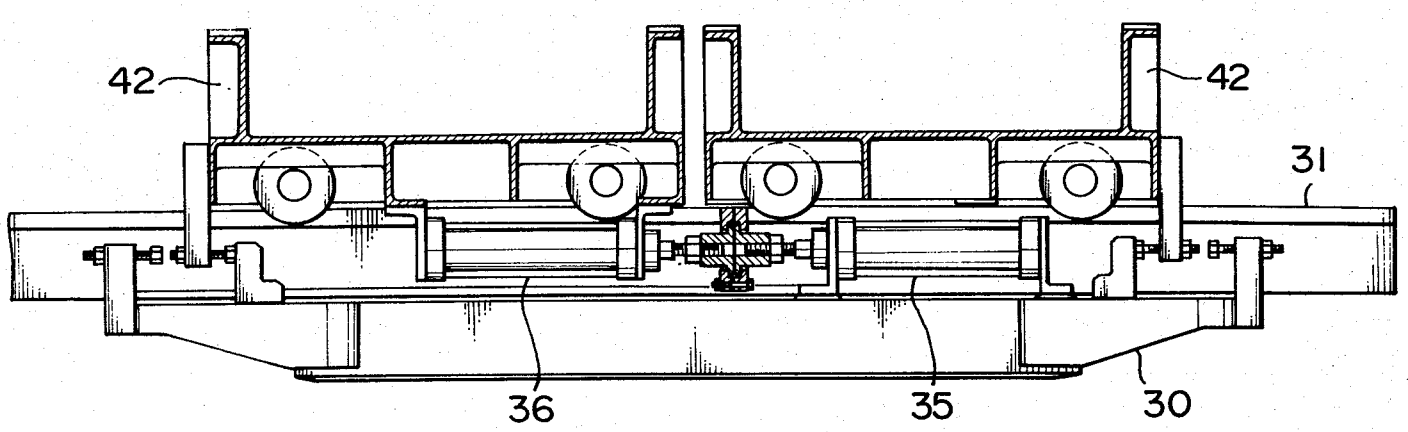
FIG. 7 is a side view from the machine frame side in FIG. 4.
Figure 8:
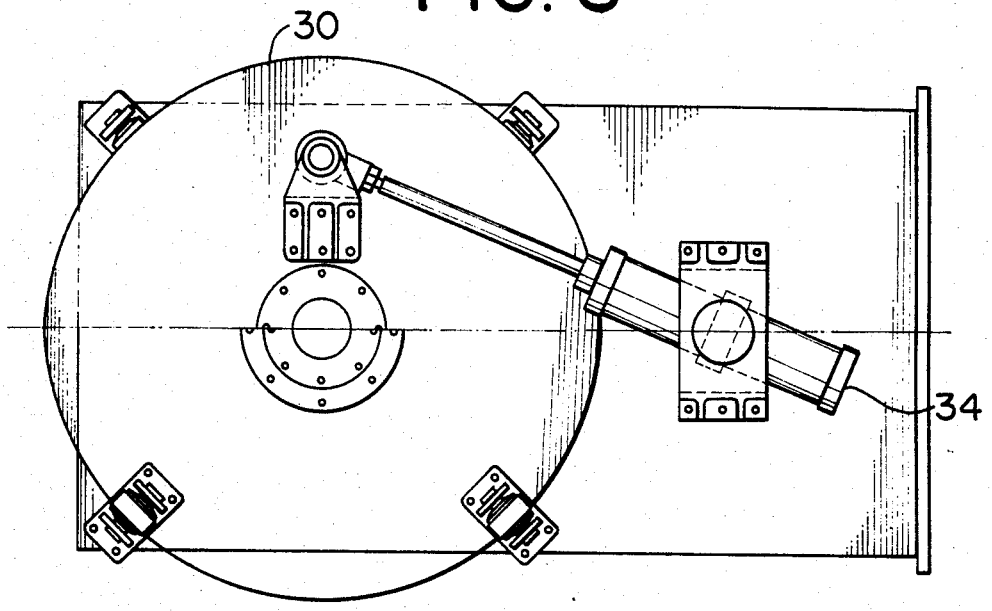
FIG. 8 is a plan view taken along the line VIII—VIII of FIG. 5, being an explanatory view of the rotating mechanism of the rotary table.
Figure 9:
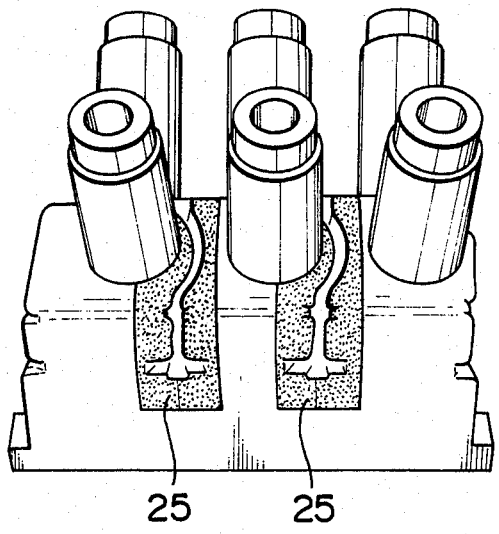
FIG. 9 is a perspective view of a core for V-type 6-cylinder engine, which core is molded according to the present invention.
Figure 10:
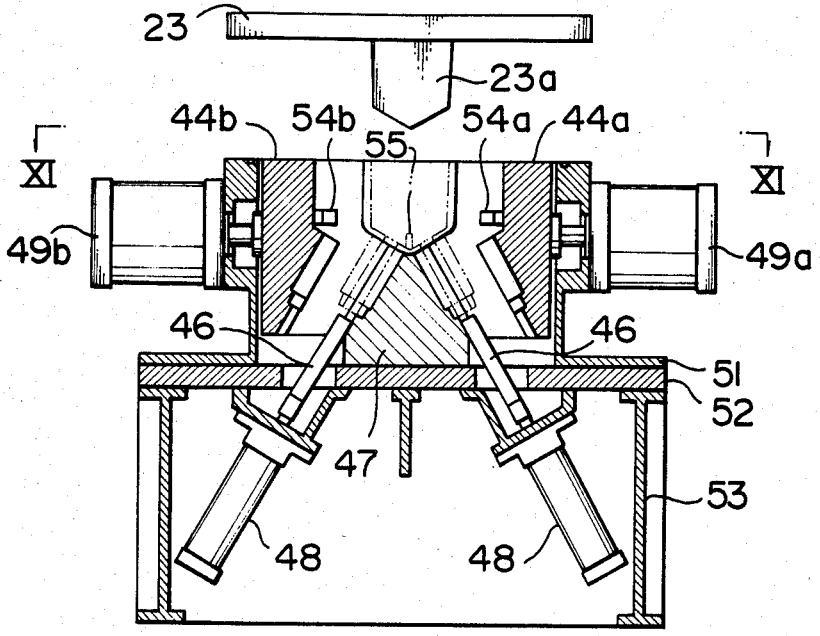
FIG. 10 is a partially sectional view of a split core box, taken along the line X—X of FIG. 11.
Figure 11:
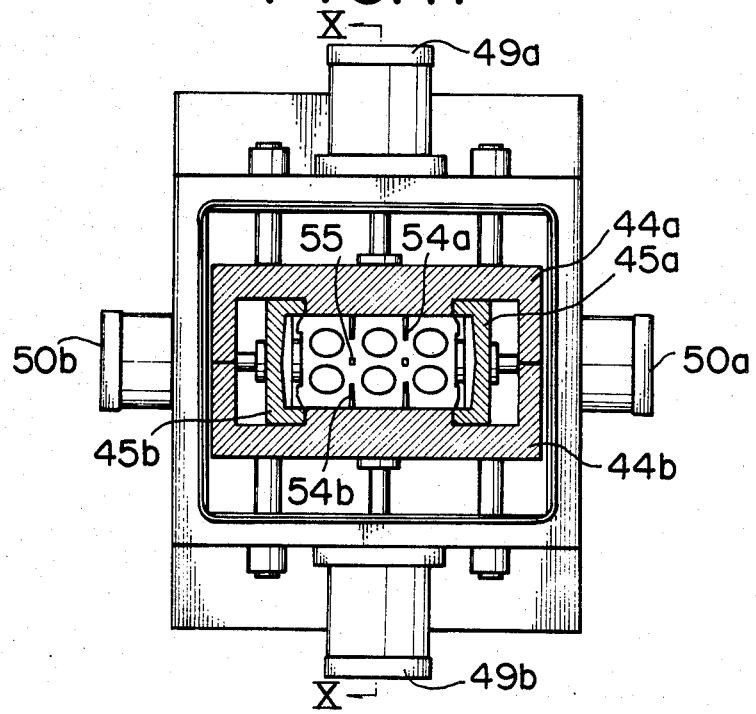
FIG. 11 is a top plan view taken along the line XI—XI of FIG. 10.
Figure 12:
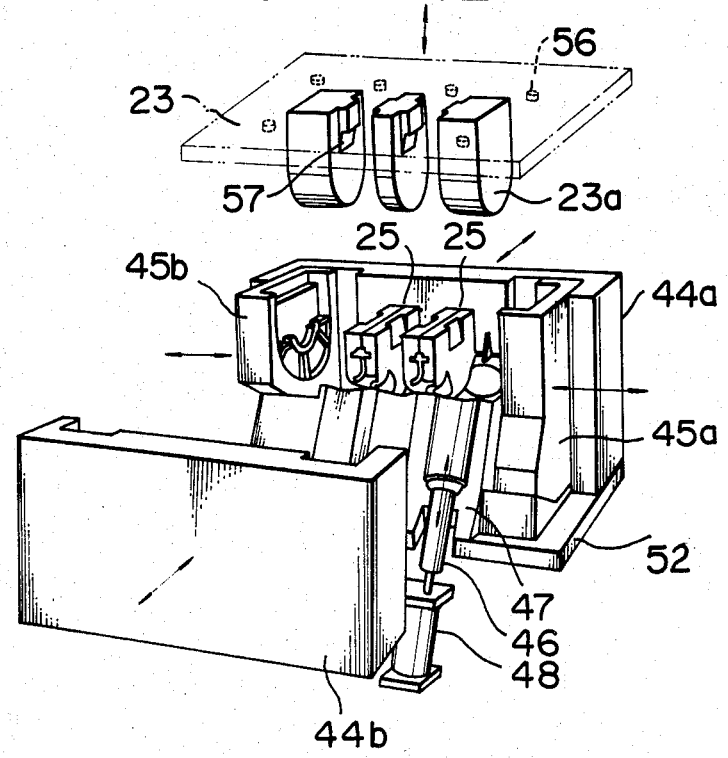
FIG. 12 is a perspective view showing an assembling state of the split core box.

In FIGS. 4 to 8, numeral 30 represents a rotary table rotated by a rotary cylinder 34 and its rotating mode is as shown in FIG. 8. Numeral 17 is a feeding means which is constructed in such manner that it may travel onto and stop at rails 31 arranged in said rotary table 30 and it may be loaded with two feeding means 17 i.e. connecting core taking-out side (P) feeding means 17 and setting side (S) feeding means 17.

Figure 5:
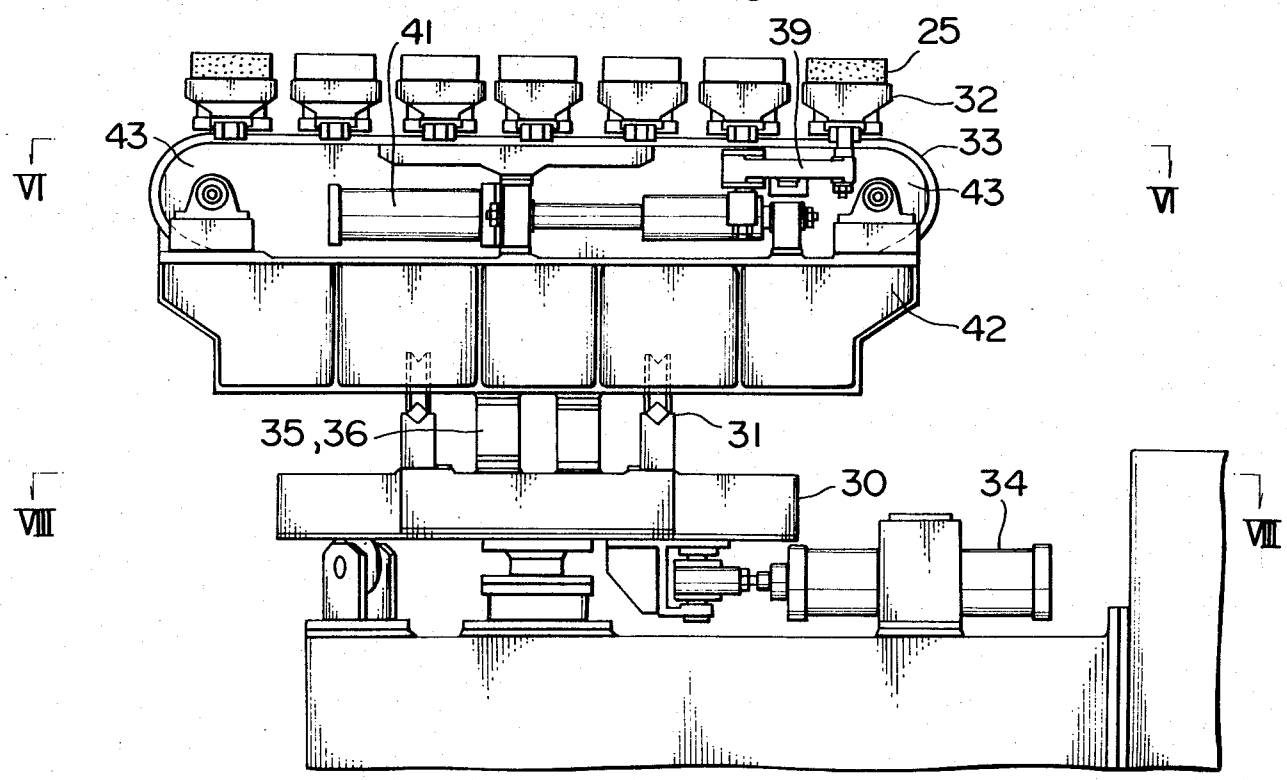
FIG. 5 is a side view of the connecting core feeding means.

Reference 42 designates underframes, on the upper surface each of which the following members are suitably provided. Two chains 33 are bridged over four wheels 43 disposed at both the sides of said underframes 42 by suitable means, and a plurality of core holders 32 are disengageably anchored to said chains 33, said holders being constructed to hold connecting cores 25. Further, as shown in FIGS. 5 and 6, in the present machine there are arranged a chain traverse cylinder 41 for said chains 33, a frame 38 fixed to the piston rod of said traverse cylinder 41, guide bars 37 for sliding said frame 38, two hooks 39, a cylinder 40 for opening or closing the hooks, etc. Furthermore, there are mounted underframe traverse cylinders 35, 36 between said rotary table 30 and said underframes 42.

Hereunder is explained the operating mode of the connecting core feeding means of the invention, which means is constructed as described above.

Figure 4:
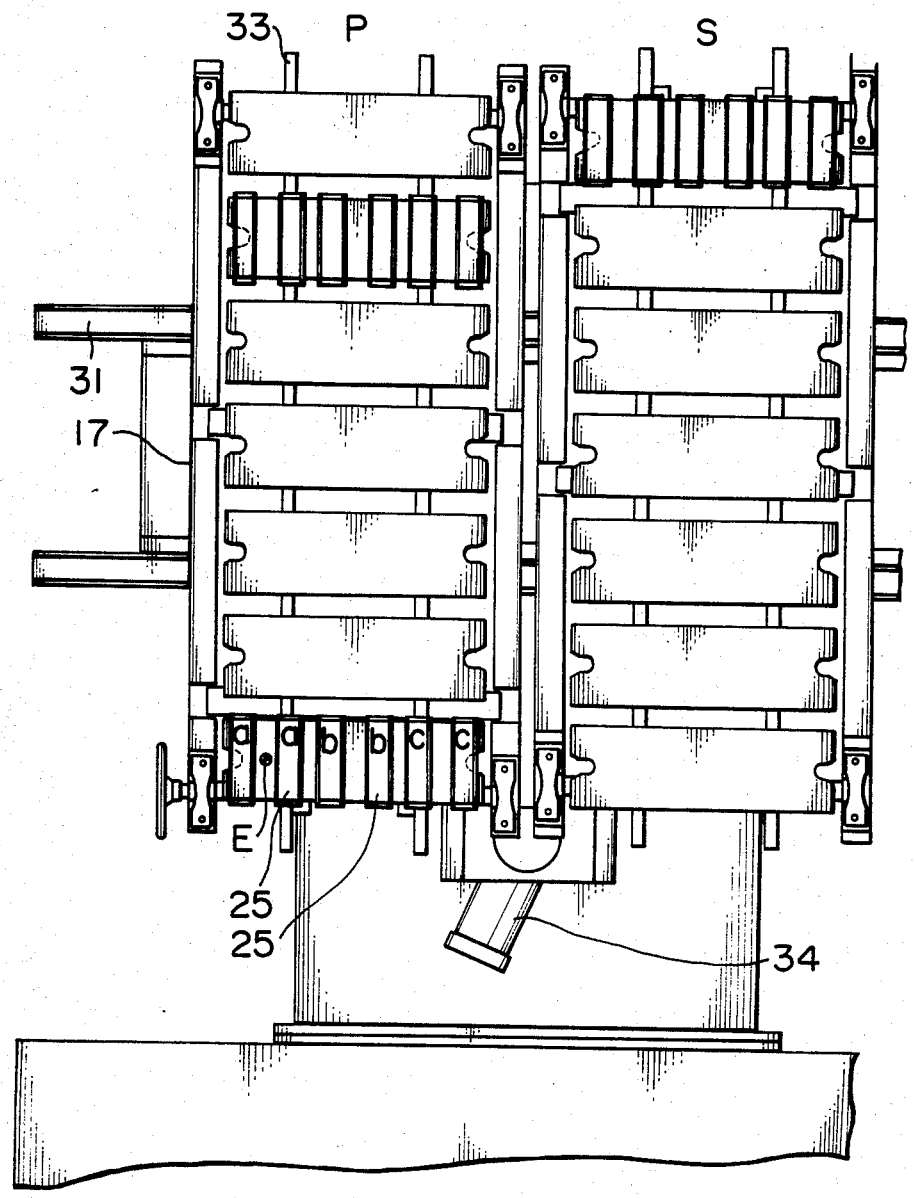
FIG. 4 is a top plan view of the connecting core feeding means.

As shown in FIG. 4 the two feeding means 17 are arranged in such manner that they can move on the rails 31 on the rotary table 30, each of said means 17 is connected by two chains 33 to a holder 32 of a connecting core 25, and said connecting core is obtained at the core holder 32 or fitted thereat at the connecting core setting side (S) (the left side feeding means) in FIG. 4.

Then the rotary table is turned 180° by a rotary cylinder 34 shown in FIG. 8, whereas the feeding means set with the connecting core is transferred to the taking-out side (P). The connecting core 25 thus transferred inserts, into the fixed position within the drag core box, two (not limited) connecting cores 25 at a in the core box inserting position (E) by the chucking device 3 at the machine side whereby a core is completed through an integral connecting molding.

Next the connecting cores 25 at the positions b in FIG. 4 are transferred to the core box inserting position (E) by a traverse cylinder 35 in FIG. 7 thereby to be inserted into the drag core box by the chucking device at the machine side.

Further, the connecting cores 25 at the positions c are transferred to the core box inserting position (E) by another traverse cylinder 36 shown in FIG. 7 thereby to be inserted into the core box of the machine.

If connecting cores 25 no longer exist in the first row the connecting cores 25 in the second row are shifted to the core box inserting position. Firstly, the traverse cylinders 35, 36 shown in FIG. 7 are returned, when core holders 32 are retracted (toward the left in FIG. 6) by said traverse cylinder 41 by releasing the chucked hooks 39 provided in the frame 38 where the guide bars 37 slide as shown in FIG. 6, by a hook switching cylinder 40, secondly the core holders 32 in the second row are chucked by the hooks 39 thereby to be advanced by the traverse cylinder 41, and thirdly the connecting cores 25 at the second row are transferred to the core box inserting position, so as to continuously supply the connecting cores 25 to the fixed position. Additionally it is possible to continuously operate the connecting molding by arranging connecting cores 25 in the core holders 32 in other feeding means during the operation at the taking-out side (P).

The machine of this invention is constructed and operated as described above, and the machine can be continuously operated for a great many cycles by setting a plurality of connecting cores onto the core holders at the setting side (S) (the right in FIG. 1), during which the operator can do other work (such as handling or molding with several machines).

According to conventional methods the worker manually inserts a connecting core into core box for each cycle, and therefore it is impossible to continuously mold with a single machine. Moreover, due to less time for doing other work the worker is unable to handle several molding machines. Additionally, in case the worker inserts connecting cores by hand a part of his body enters in core box so that it is likely that a danger occurs by erroneous operation.

The invention will then be described in detail, by way of the embodiment shown in FIGS. 9 to 13, with reference to the structure and operating mode of the split core boxes, said structure being other feature of the invention.

As shown in the drawings, the drag core box of the split core boxes of this invention is constructed as follows:

A fixed pattern 47 is provided on a die base 52, a pair of vise patterns **44*a*, 44*b* are disposed at both the sides of said fixed pattern 47, and said vise patterns 44*a*, 44*b* are supported by the pistons of vise actuating cylinders 49*a*, 49*b* provided in a pattern frame 51 and advance toward or retract from said fixed pattern 47. The inner surfaces of the vise patterns 44*a*, 44*b* are provided with core locating wedges 54*a*, 54*b*** respectively.

References **45*a*, 45*b* are a pair of loose pieces whose mechanism is such that by the operation of loose piece actuating cylinders 50*a*, 50*b* they slide within said vise patterns 44*a*, 44*b*** and in perpendicular crossing with the sliding direction of said vise patterns.

Reference 46 designates mandrels whose mechanism is such that by the operation of mandrel actuating cylinders 48 provided in the die base 52 they pass through said base 52 and slide along the outer slants of said fixed pattern 47. Reference 53 shows a mounting frame for supporting the die base 52.

The lower surface of the cope core box 23 is equipped with fixed mandels **23*a* and a number of blow ports 56**.

In case of the cold box system molding of said drag and cope core boxes i.e. in case they are hardened by passing a catalyst gas (or reaction gas) through the molding material the split core boxes are accommodated in a closed box thereby to be opened and closed therein, but in the drawings such closed box is omitted.

The split core boxes of the invention are constituted as described above, and the mode of molding operation in case they are set in the machine will be explained in order.

Figure 13:
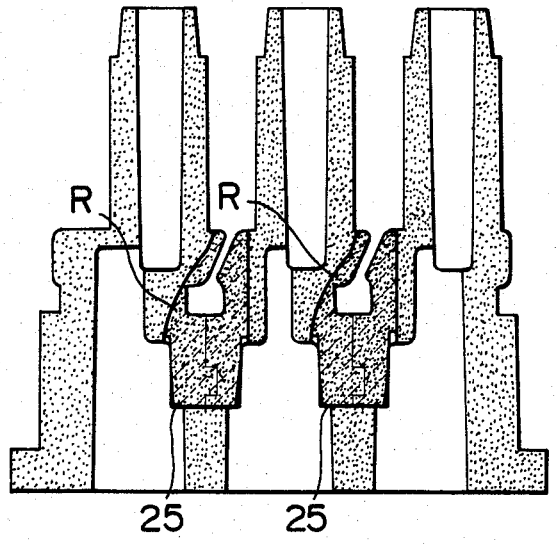
FIG. 13 is a sectional view of a molded integral connecting core, showing the disposition relationship between the connecting cores.

The previously molded, connecting cores 25 delivered by said feeding means are laid for fixation on the top of the fixed pattern 47, on which top is mounted a core locating pin 55. Then by actuating the cylinders 49*a*, 49*b* the vise patterns 44*a*, 44*b* are closed to constitute the outer side surface of a complete integral connecting core. As shown in FIG. 13, the connecting cores 25 are of construction where two cores are bonded together, and the core locating wedges 54*a*, 54*b* which will fit the bonding voids are provided in the inner surfaces of the vise patterns 44*a*, 44*b* so as to position the connecting cores 25 more accurately.

After the setting of said connecting cores 25 into the closed core box a molding material to be bonded in integrity with said cores is blown in, and therefore it is preferable that the outer configuration of said cores is such one as not impeding the fluidity of said molding material. FIG. 13 shows a cross section of an integrally connected core, and preferably at least a part of the outer surface of each of said connecting cores 25, namely the outer periphery through which the blowing, molding material passes, is shaped roundish as shown with R to form an integral body.

Then the loose pieces 45*a*, 45*b* are closed by the cylinders 50*a*, 50*b* thereby constituting the side and end surfaces of a complete, integral connecting core. The mandrels 46 lift by the cylinders 48 to enter the predetermined positions i.e. into the cylinder bores of a completed core for the engine block as shown.

The thus assembled drag core box is lifted by lifting means (not shown) to be pressed against the cope core box 23. At this time, the connecting cores 25 are prevented from moving when blowing sand or slipping of lined faces by the core locating chocks 57 provided at the side faces of said fixed mandrels 23*a* mounted at the lower surface of the cope core box 23.

The split core boxes are assembled by the above operations, when desired molding voids are completely constituted.

According to the molding machine of this invention, it is equipped with a core box exchanging car 27 and a blow plate exchanging mechanism 28 as shown in FIGS. 1 and 2, besides the above constitutional features. Said car 27 and said mechanism 28 are outlined as follows:

The core box exchanging car 27 is arranged as shown in FIGS. 2 and 3, and it is constructed in such a way that it supports the cope core box 23 dismantled from the machine frame, by raising the drag car 5, then said car 5 is lowered to a predetermined position (as shown in FIG. 2), and thereafter by actuating the traverse cylinder 6 for said drag car 5 loading the cope core box 23 is shifted to the take-out center (C) to release the hooks and to be loaded on the core box exchanging car 27 by said core box exchanging cylinder 29, and a separate drag car 5 is reversely operated for setting.

In case the core boxes are exchanged with heterogeneous ones it is natural that blow plate is also exchanged. The machine is of such mechanism that in such case the blow head 10 is positioned right above the blow plate exchanging mechanism 28 by actuating the traverse cylinder 12 for blow head, said exchanging mechanism 28 is lifted to receive the blow plate released from the blow head 10, said exchanging mechanism 28 is then horizontally turned for exchanging with a new blow plate, and the blow plate is mounted to the blow head 10 by the operation reverse to the above.

The molding machine of this invention is constructed and operated as described above, and the functions and effects produced therefrom may be mentioned as follows:

(1) It is capable of feeding cores automatically by means of rotary feeding means 17 for connecting cores 25 and without stopping the machine.

(2) The connecting cores 25 are fed intermittently in order to the supply position by said feeding means 17.

(3) The connecting core 25 on the feeding means 17 is charged, being accurately positioned, into the drag core box 22 by the core transfer mechanisms 1, 2.

(4) The machine is a laboursaving mechanism in that an integrally connected core is automatically formed and taken out onto the delivery conveyor without needing men's work.

(5) Automation (labour saving) applies not only for molding working but also for such work as exchanging core box and blow plate and mounting or dismantling blow plate.

(6) A mixer is provided for constantly mixing and supplying a suitable amount of cold box molding sand, for which a shorter period of time is used.

(7) With the sealing applied only to the closed box, sealing is not required for each of the split core boxes so that the dimension of the completed core is of high precision.

(8) Since the connecting cores are correctly positioned the dimension of the completed core is of high precision.

(9) In case sand is badly fluidized or filled in the molding voids because of using connecting cores it is possible to optionally design the configuration of the integrally connecting portions of said connecting cores.

(10) Compared with other molding methods such as hot box system the core is of precise dimension, the core is hardened homogeneously and thoroughly, and the connecting cores can be closely bonded in integrity with the molding material.

(11) Though the completed core is of complicate shape it has become easier to design the molding machine since the dimension of core box became compact.

(12) Cores have become compact thanks to the synergistic effect brought about by the advantages proposed for core boxes and connecting cores as mentioned in Items (1) to (3) above, in addition to the fact that it has become possible to mold an intricately-shaped, complete core in an integral state, and it is now capable of planning to make cast articles small and light. This leads to making engines small and light so as to greatly contribute to an energy saving.

We claim:

1. A connecting core feeding apparatus for an entirely automatic, cold box type machine for molding an integral connecting core, comprising:

an underframe;

two feeding means mounted in parallel on said underframe for longitudinally feeding a plurality of connecting core holders to a pickup position with each said connecting core holder holding a plurality of cores laterally arranged thereon, each said feeding means including (a) endless traverse chain mounting means for mounting the plurality of connecting core holders disengagably thereto, (b) a hook cylinder for selectively engaging one of said connecting core holders, and (c) a chain traverse cylinder to which said hook cylinder is attached which reciprocally moves said hook cylinder parallel to the direction of movement of the respective said feeding means whereby said connecting core holders are successively advanced along said respective feeding means to the pickup position;

rail mounting means for mounting said underframe for lateral movement of the connecting core holders of both said feeding means;

a rail traverse cylinder means for moving said underframe along said rail mounting means such that cores on the core holder located at the pickup position are successively moved laterally to a pickup point;

a rotary table on which said rail mounting means is located, said rotary table being mounted for rotation about a plane parallel to the plane of movement of both said feeding means; and a rotary means for rotating said rotary table 180° whereby each said feeding means exchanges places with the other said feeding means.

* * * * *